US005556483A

United States Patent [19]

Tahara et al.

[11] Patent Number: 5,556,483

[45] Date of Patent: Sep. 17, 1996

[54] METHOD OF CARBURIZING AUSTENITIC METAL

[75] Inventors: Masaaki Tahara, Takatsuki; Haruo Senbokuya, Tondabayashi; Kenzo Kitano, Kawachinagano; Tadashi Hayashida, Sakai; Teruo Minato, Hashimoto, all of Japan

[73] Assignee: Daido Hoxan, Inc., Sapporo, Japan

[21] Appl. No.: 325,666

[22] Filed: Oct. 19, 1994

(Under 37 CFR 1.47)

[30] Foreign Application Priority Data

Apr. 18, 1994 [JP] Japan ..... 6-078677

[51] Int. Cl.[6] ..... C23C 8/20; C23C 8/22; C21D 1/06

[52] U.S. Cl. ..... 148/206; 148/225

[58] Field of Search ..... 148/217, 225, 148/206

[56] References Cited

U.S. PATENT DOCUMENTS 3,765,929 10/1973 Martin .
4,957,421 9/1990 Baldi ..... 419/8
5,013,371 5/1991 Tahara et al. .
5,141,567 8/1992 Tahara et al. ..... 148/217
5,340,412 8/1994 Yoshino et al. ..... 148/208

FOREIGN PATENT DOCUMENTS

0408168A1 1/1991 European Pat. Off. .
59-013065 1/1984 Japan .
60-067651 8/1985 Japan .

*Primary Examiner*—Deborah Yee
*Attorney, Agent, or Firm*—Armstrong, Westerman, Hattori, McLeland & Naughton

[57] ABSTRACT

A method for carburizing austenitic metal comprising fluorinating the austenitic metal and consecutive carburizing at a low temperature not more than 680° C. A carburizing temperature can be lowered by such a fluorination. As a result, carbide of chrome component in the austenitic metal can be prevented from depositing. That is, much chrome component remains in the austenitic metal. Therefore, the austenitic metal surface can be hardened and also superior anti-corrosion property can be maintained.

12 Claims, 5 Drawing Sheets

METHOD OF CARBURIZING AUSTENITIC METAL

FIELD OF THE INVENTION

This invention relates to a method of carburizing austenitic metal for hardening its surface.

BACKGROUND OF THE INVENTION

Austenitic stainless steel, especially austenitic stainless steel, has been widely employed for its superior corrosion resistance property and excellent processability. However, the above austenitic stainless steel and the like do not have quenching hardenability and also are not so superior in processing hardenability. Therefore, they are not suitable for the use for parts demanding high wear resistance.

Thus, austenitic metal represented by austenitic stainless steel has superior corrosion resistance property and excellent processability, however, the austenitic metal also has a drawback of being easily damaged due to low hardness, which causes a big problem. Generally, besides the above quenching, there are methods such as ① carburization, ② nitriding and the like for improving hardness. The carburization is a method comprising steps of heating low carbon steel or low alloy steel at a temperature not less than A1 transformation temperature (approximate 720° C.), maintaining it as an austenite phase, spreading "C" to be penetrated into the surface of the above steel under RX gas or gas mixture containing CO so as to be hardened. Carburizing is conducted usually at a temperature not less than A1 transformation temperature (approximate 720° C.) since solubility of "C" to a ferrite phase is extremely low at a temperature not more than 700° C. in case of steel other than austenitic metal.

By the way, it is said that anti-corrosion property to the above austenitic metal represented by austenitic stainless steel emerges due to a passive coat layer produced on the surface, which includes $Cr_2O_3$. This passive coat layer is strong even in the temperature range of 300° to 700° C. and prevents not only penetration of corrosive substances but also penetration of nitrogen atoms and carbon atoms and the like which are employed for nitriding and carburizing.

As the above ① of carburizing the austenitic metal wherein such a passive coat layer is formed, there is a method that the austenitic metal is heated over 700° C. to destroy or weaken the above passive coat layer and then carbon atoms are penetrated thereon. Carburizing is impossible and actually has not yet been put into practical use because the passive coat layer exists at a temperature not more than 700° C., greatly lower than A1 transformation temperature of steel.

However, if the austenitic metal is heated over 700° C. as mentioned above, the passive coat layer is removed or weakened but also the overall strength is deteriorated because the inner part (the core) of the austenitic metal itself softens, wherein minimum strength for mechanical parts cannot be retained. Therefore, carburizing for austenitic metal has scarcely conducted industrially heretofore.

On the other hand, as the above ② of nitriding austenitic metal for improving the hardness, there are mainly the following three methods heretofore.

A first method is salt bath nitriding employing NaCNO, KCNO or the like, which weakens the passive coat layer on the surface of the above austenitic metal by setting up a temperature at 500° to 600° C., so that nitrogen atoms are penetrated therein.

In a second method, firstly the above passive coat layer on the surface of the above austenitic metal is destroyed and removed by sputtering, and then the austenitic metal is nitrided with $N_2$ gas, $NH_3$ gas or the like.

According to these two methods, the passive coat layer is weakened or removed, so that nitrogen atoms penetrate into the inside of the austenitic metal to some extent. However, there is a drawback that anti-corrosion property, the characteristic inherent in austenitic metal, greatly deteriorates because chrome concentration on the surface lowers.

Besides, there is another problem that the surface roughness becomes worse by nitriding and also dimension accuracy deteriorates because the austenitic metal itself swells by introduction of nitrogen atoms. In addition, there is still another problem that the austenitic metal itself is magnetized by the above nitriding.

The third method, which we developed and made a patent application to Japan Patent Office (application number JP1-177660 and JP1-333424), is that the surface of the austenitic stainless steel is heated under fluoride-containing gas atmosphere such as $NF_3$ prior to the above nitriding. In this method, the passive coat layer including $CrO_3$, formed on the surface of the austenitic stainless steel, is converted into a fluorinated layer by the above previous treatment, and then nitriding treatment is conducted under normal condition. Thereby, nitrogen atoms in nitrogen gas penetrate into the austenitic stainless steel through its surface to a specific extent uniformly so as to form a deep uniform nitride layer and at the same time the above fluoride layer is removed by contacting with moisture or hydrogen and the like in nitriding gas. Compared with the above ① and ②, our method enables more excellent nitriding, resulting in austenitic stainless steel with preferable hardness. However, even in our method, the same problems may be caused depending on circumstances; anti-corrosion property may deteriorate, the surface roughness may become worse, nitride articles may swell or be magnetized, which requires improvement.

OBJECT OF THE INVENTION

Accordingly it is an object of the invention to provide a method of carburizing austenitic metal at a low temperature between about 400° and 700° C., which has been thought to be impossible, by holding austenitic metal with heating under fluoride-containing gas, introducing known carburizing gas therein, and then carburizing it at a temperature not more than 680° C. with known carburizing gas.

DISCLOSURE OF THE INVENTION

During a series of studies to improve technology for better surface hardness of austenitic metal, we came up with an idea that carburizing becomes possible at a temperature not more than A1 transformation temperature of steel if we use fluoride-containing gas we developed before. During a process based upon this idea, we found out that carburizing becomes possible if the austenitic metal is treated with fluoride-containing gas prior to carburizing or at the same time as carburizing. We also found out that more effective carburizing can be realized at not more than 680° C., preferably not more than 600° C., instead of not less than 700° C. employed heretofore.

The present invention is now described in further detail.

In the present invention, austenitic metal is carburized after pre-treatment with fluoride-containing gas or at the same time of the pre-treatment.

As the above austenitic metal, there are austenitic stainless steel containing iron not less than 50% by weight (hereinafter just as abbreviated as wt %) and chrome not less than 10 wt %, or austenitic stainless steel containing iron at about 70 wt %, nickel at about 10 wt % and chrome at about 20 wt % or the like. Specifically, they are 18-8 stainless steel such as SUS316 and SUS304, or SUS310 or SUS309, austenitic stainless steel containing 23 wt % chrome and 13 wt % nickel, or further two-phase austenite-ferrite stainless steel containing 23 wt % chrome and 2 wt % molybdenum and the like. Furthermore, incoloy (Ni: 30 to 45 wt %, Cr: not less than 10 wt %, the remainder: Fe and the like), which is heat resisting steel, is contained. Besides, the above austenitic steel includes nickel base alloy containing nickel not less than 45 wt %, 20 wt % chrome, 30 wt % iron plus molybdenum or the like as the remainder. Thus, austenitic metal is defined in this invention as all metal showing austenitic phase substantially, which means containing austenitic phase not less than 60 wt %. Therefore, austenitic metal here contains Fe-Cr-Mn metal, which substitutes Ni with Mn, an austenitic stable element.

Prior to or at the same time as carburizing, fluorinating treatment is conducted under fluoride-containing gas atmosphere. Fluoride-containing gas is employed for this fluorinating treatment. As the above fluoride-containing gas, there are fluoride compound comprising $NF_3$, $BF_3$, $CF_4$, HF, $SF_6$, $C_2F_6$, $WF_6$, $CHF_3$, $SIF_4$ and the like. These are employed solely or in combination. Besides, fluorine compound gas with F in its molecule can be used as the above-mentioned fluoride-containing gas. Also $F_2$ gas formed by cracking fluorine compound gas in the heat decomposition device and preliminarily formed $F_2$ gas are employed as the above-mentioned fluoride-containing gas. According to the case, such fluorine compound gas and $F_2$ gas are mixed for the use. The above-mentioned fluoride-containing gas such as the fluorine compound gas and $F_2$ gas can be used independently, but generally are diluted by inert gas such as $N_2$ gas for the treatment. The concentration of fluoride-containing gas itself in such diluted gas should amount to, for example, 10,000 to 100,000 ppm, preferably 20,000 to 70,000 ppm, more preferably 30,000 to 50,000 ppm by capacity. In the light of practicability, $NF_3$ is the best among the above compound gases. This is because $NF_3$ has chemical stability and is easy to treat since it is in a state of gas at normal temperature. Such $NF_3$ gas is usually employed in combination with the above $N_2$ gas within the above concentration range.

In the invention, first of all, the above-mentioned non-nitrided austenitic metal is held in a heated condition in a fluoride-containing gas atmosphere within the above concentration range, and then fluorinated. In this case, the austenitic metal is held with heating at the temperature of, for example, 250° to 600° C., preferably 280° to 450° C. The holding time of the above-mentioned austenitic metal may be generally within the range of ten or so minutes or scores of minutes. The passive coat layer, which contains $Cr_2O_3$, formed on the surface of the austenitic metal, is converted to a fluorinated layer. Compared with the passive coat layer, this fluorinated layer is thought to be readily penetrated with carbon atoms employed for carburizing. That is, austenitic metal surface is formed to the suitable condition for penetration of "C" atoms by the above-mentioned fluorination.

Then, carburizing is conducted after the fluorination treatment like the above. In the carburizing, the above austenitic metal itself is heated at not more than 680° C., preferably not more than 600° C., more preferably between 400° and 500° C. under carburizing gas atmosphere, comprising $CO_2$ and $H_2$, or comprising RX [RX component: 23% by volume CO (as abbreviated just as vol % hereinafter), 1 vol % $CO_2$, 31 vol % $H_2$, 1 vol % $H_2O$, the remainder $N_2$; RX gas hereinafter is the same component] and $CO_2$ in a furnace. Thus, the biggest characteristic in this invention is a low carburizing temperature in which the core part of austenitic metal may not be softened and solubilized. In this case, the ratio of $CO_2$ and $H_2$ is preferably 2 to 10 vol % for $CO_2$ and 30 to 40 vol % for $H_2$ and the ratio of RX and $CO_2$ is preferably 80 to 90 vol % for RX and 3 to 7 vol % for $CO_2$. Besides, a gas mixture of CO, $CO_2$ and $H_2$ may be employed for carburizing. In this case, the each ratio of 32 to 43 vol % for CO, 2 to 3 vol % for $CO_2$ and 55 to 65 vol % for $H_2$ is preferable.

By this treatment, "carbon" diffuses and penetrates on the surface of austenitic metal so as to form a deep uniform layer. Such a layer realizes drastic improvement in hardness compared with the base material and also retains anti-corrosion property as same as that of the base material, because the layer comprises a phase wherein carbide such as $Fe_3C$ and $Cr_{23}C_6$ is deposited or/and a phase wherein γ-phase of austenitic metal is greatly distorted due to solution of excessive "C". For example, an SUS316 plate, a typical austenitic stainless steel, is carburized as follows. Firstly the SUS316 plate is introduced into a furnace and is fluorinated at 300° C. for 40 minutes under fluoride-containing gas atmosphere of $NF_3$ and $N_2$ ($NF_3$: 10 vol %, $N_2$: 90 vol %). After exhausting the above fluoride-containing gas, a carburizing gas of CO, $CO_2$ and $H_2$ (32 vol % CO, 3 vol % $CO_2$ and 65 vol % $H_2$) was introduced into the furnace so that the SUS316 plate was kept at 450° C. in the furnace for 16 hours. As a result, a hard layer having a surface hardness of Hv of 880 (NB. the core part is Hv of 230 to 240) and a thickness of 20 μm was formed. When this sample was put to the salt spray test (abbreviated just as SST hereinafter) according to JIS2371, it did not rust at all over 480 hours. Further, the hard layer was not etched by Billrer reagent (acidic picric acid alcohol solution), which is employed for anti-corrosion test of a hard layer, and was barely etched by aqua regia. Furthermore, the surface roughness hardly deteriorated, and dimension change by blister and magnetism did not occur in the above sample. As a result of our further study by varying the combination of a various kinds of austenitic metal plates, carburizing temperatures and the like, we found out that the core of austenitic metal easily softens and also anti-corrosion property deteriorates when a carburizing temperature is over 680° C. It was found out that from a viewpoint of anti-corrosion property, a carburizing temperature is preferably not more than 600° C., more preferably not more than 500° C., which brings about a good result. As mentioned above, a more preferable carburizing temperature is 400° to 500° C. In addition, it was clarified that among austenitic metal, a stable austenitic stainless steel having molybdenum and nickel as much as possible shows a good anti-corrosion property after being hardened.

The above-mentioned fluoriding and carburizing steps are, for example, taken in a metallic muffle furnace as shown in FIG. 1, that is, the fluoriding treatment is carried out first, and then carburizing treatment is put in practice at the inside of the muffle furnace. In FIG. 1, the reference numeral 1 is a muffle furnace, 2 an outer shell of the muffle furnace, 3 a heater, 4 an inner vessel, 5 gas inlet pipe, 6 an exhaust pipe, 7 a motor, 8 a fan, 11 a metallic container, 13 vacuum pump, 14 a noxious substance eliminator, 15 and 16 cylinders, 17 flow meters, and 18 a valve. Austenitic stainless steel products 10 are put in the furnace 1 and fluorinated by introducing from cylinder 16, connected with a duct, fluoride-containing gas atmosphere such as $NF_3$ with heating. The gas is led into the exhaust pipe 6 by the action of vacuum pump 13 and detoxicated in the noxious substance eliminator 14 before being spouted out. And then, the cylinder 15 is connected with a duct to carry out carburizing by introducing carburizing gas into the furnace 1. Finally, the gas is spouted out via the exhaust pipe 6 and the noxious substance eliminator 14. Through the series of these operations, fluoriding and carburizing treatments are put in practice.

Thus, according to the carburizing of this invention, the articles under such a treatment retains excellent anti-corrosion property, which is thought to be due to a following reason. Since fluorinating treatment is conducted prior to carburizing, a low carburizing temperature not more than 680° C. can be realized. By this carburizing at a low temperature, chrome element, which is thought to work for improving anti-corrosion property, in austenitic metal is difficult to precipitate and fix as carbide such as $Cr_7C_2$, $Cr_{23}C_6$ or the like and then the volume of precipitation for fixation lowers. As a result, much chrome element remains in the austenitic metal. This is clear by comparing FIG. 3 and FIG. 2(*b*) with FIG. 2(*a*). FIG. 3 shows an x-ray diffraction result for an SUS316 article, which was fluorinated under fluoride-containing gas of 10 vol % $NF_3$ and 90 vol % $N_2$ at 300° C. for 40 minutes and then carburized under a carburizing gas of 32 vol % CO, 3 vol % $CO_2$ and 65 vol % $H_2$ at 600° C. for 4 hours. FIG. 2 (*b*) shows an x-ray diffraction result for an SUS316 article, which was fluorinated in the same way and carburized at 450° C. for 16 hours. On the other hand, FIG. 2 (*a*) shows an x-ray diffraction result for an SUS316 article, which was untreated. That is, a peak of $Cr_{23}C_6$ is sharp and high in carburizing at 600° C. in FIG. 3. This means that the above carbide precipitates relatively much while less chrome element remains in austenitic metal. On the other hand, a peak of $Cr_{23}C_6$ can hardly identified in carburizing at 450° C. in FIG. 2 (*b*). This means that the precipitation of the above chromium carbide is extremely low while more chrome element remains in austenitic metal, resulting in high anti-corrosion property.

Furthermore, improvement in hardness of carburized articles is thought to be attributed to occurrence of γ-lattice distortion by penetration of carbon atoms. It is clear that γ-lattice distortion is caused in a carburized article in FIG. 2 (*b*) and (*c*), because each γ-phase peak position of a carburized article at 450° C. [FIG. 2(*b*)] and a carburized and acid-treated article at 480° C. [FIG. 2(*c*)] according to an x-ray diffraction shift to low angle side (left side) from that of untreated SUS316 article. In addition, the above x-ray diffraction was conducted by RINT1500 device at 50KV, 200mA and Cu target.

In the present invention, when a carburizing temperature increases, especially surpasses 450° C., a phenomenon that carbide such as $Cr_{23}C_6$ precipitates on the surface of the hard layer although it is a very small amount. However, even in this case, if an article carburized at not more than 500° C. is soaked into strong acid such as HF-$HNO_3$, HCL-$HNO_3$ or the like to remove the above precipitation, anti-corrosion property as same level as the base material and also excellent surface hardness not less than Hv of 850 in Vickers hardness can be retained. FIG. 2(*c*) shows x-ray diffraction chart of an SUS316 article which is carburized at 480° C. and then soaked into strong acid of 5 vol % HF and 15 vol % $HNO_3$ concentration for 20 minutes, wherein no carbide was observed.

EFFECT OF THE INVENTION

As mentioned hereinbefore, carburizing austenitic metal according to the invention realizes a low carburizing temperature not more than 680° C. because the austenitic metal is kept being heated under fluoride-containing gas prior to or at the same time as carburizing. Therefore, high surface hardness can be realized without deteriorating anti-corrosion property and high processability inherent in austenitic metal itself. In addition, since the surface hardness is improved thanks to the above carburizing, any inconveniences such as surface roughness caused by nitriding, dimension inaccuracy by blister and magnetization in austenitic metal itself do not occurr at all.

The following examples and comparative examples are further illustrative of the invention.

EXAMPLE 1 AND COMPARATIVE EXAMPLE

Each plank of 2.5 mm thick of SUS316 (Cr: 18 wt %, Ni: 12 wt %, MO: 2.5 wt %, Fe: the remainder) and SUS304 (Cr: 18 wt %, Ni: 8.5 wt %, Fe: the remainder) was prepared as examples. Further, a plank of 1 mm thick of NCF601 (Ni: 60 wt %, Cr: 23 wt %, Fe: 14 wt %), nickel base material, was prepared. As comparative examples, each plank of 2.5 mm of SUS430 (C: 0.06 wt %, Cr: 17.5 wt %, Fe: the remainder), ferrite stainless steel, and $SUS420J_2$ (C: 0.32 wt %, Cr: 13 wt %, Fe: the remainder) was prepared.

Figure 1:
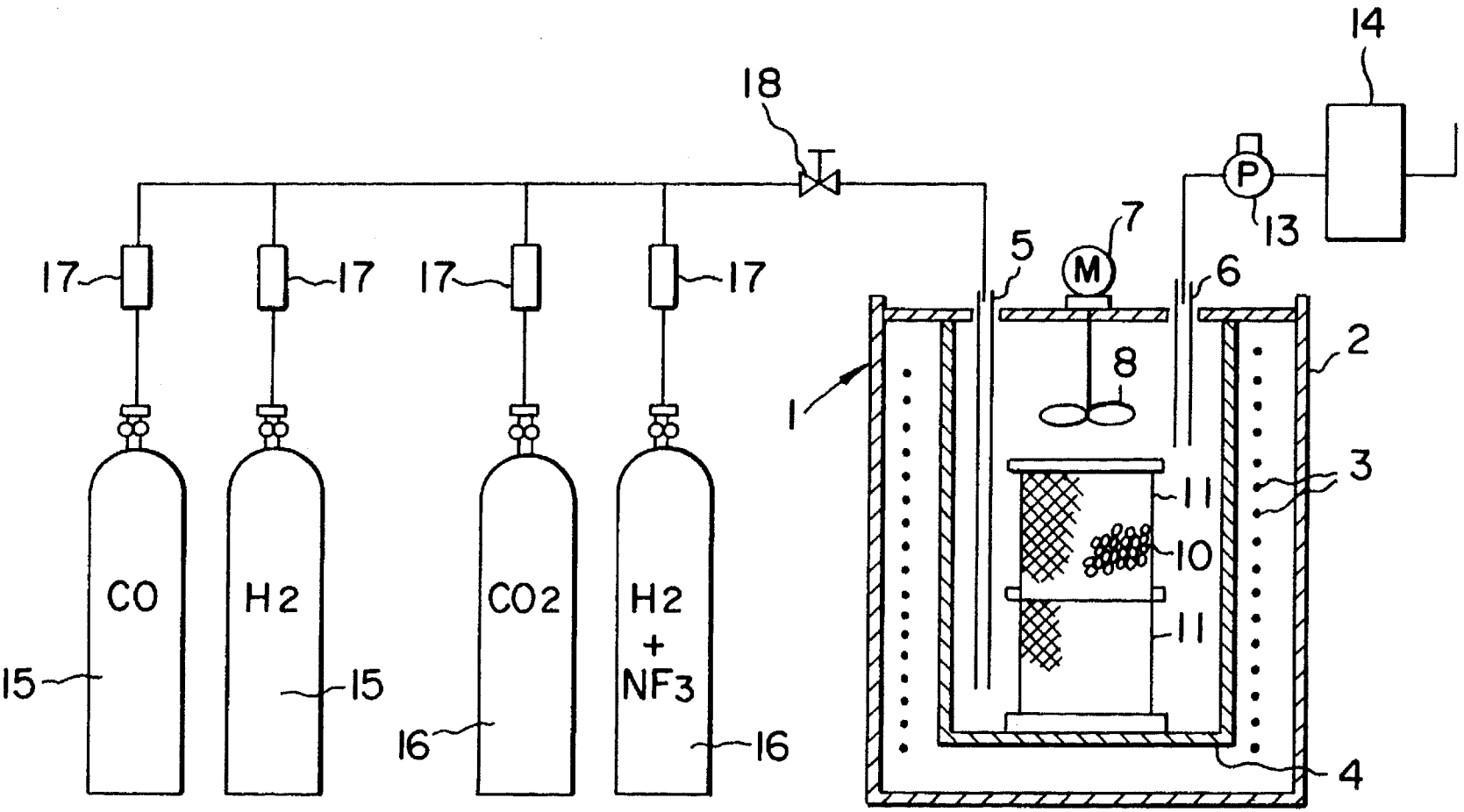
FIG. 1 schematically shows a construction of a furnace for carrying out carburizing according to the invention, FIG. 2 (*a*) shows a curve of x-ray diffraction on untreated SUS316 article, (b) shows a curve of x-ray diffraction on carburized SUS316 article at 450° C. and (c) shows a curve of x-ray diffraction on an SUS316 article, which was carburized at 480° C. and treated with strong acid.

Next, these materials were charged into a muffle furnace 1 as shown in FIG. 1. The inside of the muffle furnace 1 was vacuum-purged and heated to 300° C. Then, in that state, fluoride containing gas ($NF_3$ 10 vol %+$N_2$ 90 vol %) was introduced into the muffle furnace 1 to form an atmospheric pressure therein and such a condition was maintained for 10 minutes for fluorination. Then after exhausting the above-mentioned fluoride-containing gas out of the furnace 1, the inside of the furnace was heated up to 450° C. and, in that state, carburizing gas (CO: 10 vol %, $CO_2$: 2 vol %, $H_2$: 10 vol %, $N_2$: the remainder) was introduced into the furnace 1 and kept for 16 hours for carburizing.

The surface of samples obtained from examples (SUS316, SUS304 and NCF601) became black. The surface of samples obtained from comparative examples did not become black. Next, the above black layer on the surface of examples was rubbed out and then surface hardness and thickness of the hard layer were measured. In addition, the same measurement was conducted on comparative examples for comparison. The results are shown in the following table 1.

TABLE 1

| | SURFACE HARDNESS (HV) (CORE HARDNESS) | THICKNESS OF A HARD LAYER (μ) |
|---|---|---|
| EXAMPLES | | |
| SUS316 | 870 to 890 (230 to 240) | 20 |
| SUS304 | 900 to 920 (320 to 350) | 22 |
| NCF601 | 720 to 730 (300 to 320) | 12 |
| COMPARATIVE EXAMPLES | | |
| SUS430 | 190 to 210 (190 to 210) | None |
| SUS420J$_2$ | 190 to 210 (190 to 210) | None |

Figure 4:
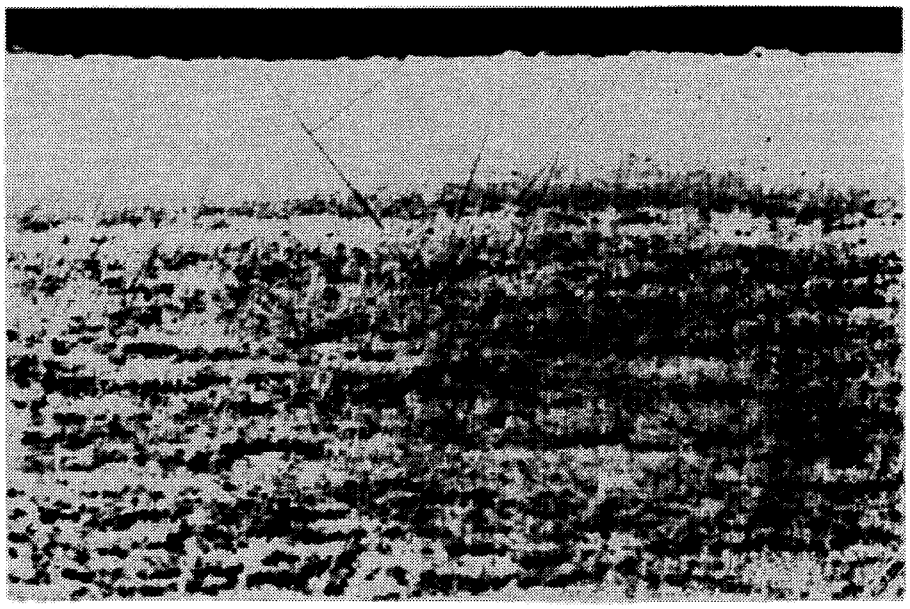
FIG. 4 shows a sectional microphotograph of an SUS316 article which was carburized at 450° C.
Figure 5:
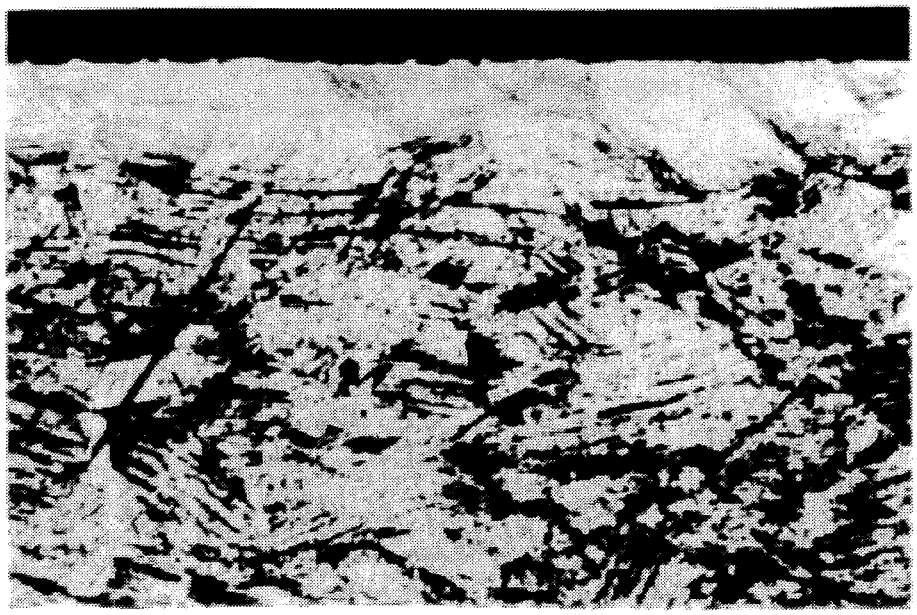
FIG. 5 shows a sectional microphotograph of an SUS304 article which was carburized at 450° C.
Figure 6:
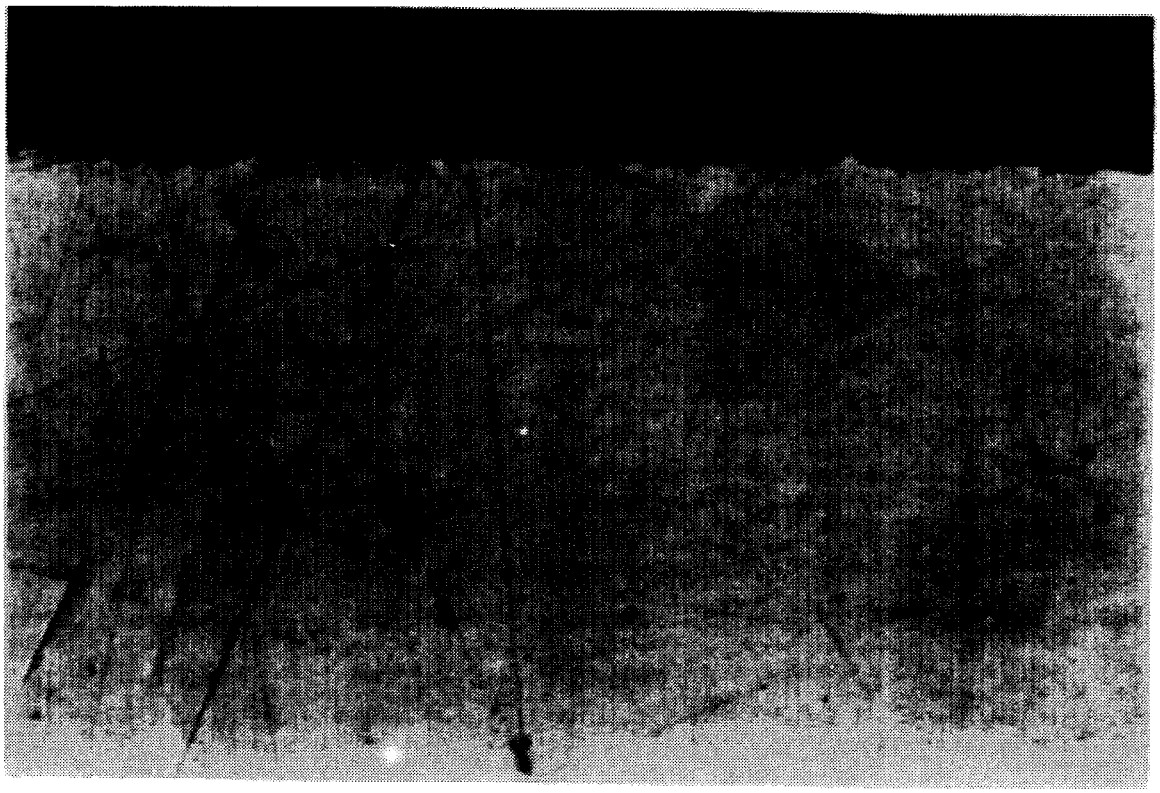
FIG. 6 shows a sectional microphotograph of an NCF601 article which was carburized at 450° C.

As clear from the above results, the surface hardness of every example was drastically improved by carburizing, wherein a hard layer was formed, while such phenomenon could not be seen in comparative examples at all. Furthermore, each sectional microphotograph of the examples SUS316, SUS304 and NCF601 were shown respectively in FIG. 4, FIG. 5 and FIG. 6. These photographs were taken at ×600 magnification by an optical microscope. In these figures, from the bottom, a base layer, a hard layer and a resin layer (black part) were shown. In addition, the above resin layer comprises resin wherein a sample is embedded therein.

Next, the above examples were polished by emery paper, and were subjected to another kind of anti-corrosion test by salt spray test according to JIS Z 2371 and soaking into 15% $HNO_3$ of 50° C., and also each magnetic permeability was measured. The results for untreated SUS316, SUS304 and NCF601 articles, and also their nitrided articles were shown in Table 2.

TABLE 2

| | SUS316 | SUS304 | NCF601 |
|---|---|---|---|
| Time to rust by SST | | | |
| Untreated | not less than 480 h | not less than 480 h | not less than 480 h |
| Nitrided at 580° C. | 1.5 h | 1.5 h | not less than 480 h |
| Example 1 | not less than 480 h | 24 h | not less than 480 h |
| $HNO_3$ soaking 50° C. 15% | | | |
| Nitrided at 580 ° C. | $H_2$ bubble occurred | $H_2$ bubble occurred | Black surface |
| Example 1 | No change | No change | No change |
| Magnetic permeability (μ) | | | |
| Untreated | 1.002 | — | — |
| Nitrided at 580° C. | 1.251 | — | — |
| Example 1 | 1.002 | — | — |
| Plank blister dimension accuracy (mm) | | | |
| Untreated | 2.495 | 2.495 | 1.004 |
| Nitrided at 580° C. | +0.015 | +0.015 | +0.007 |
| Example 1 | +0.002 | +0.003 | +0.001 |

Nitrided comparative examples of the above SUS316, SUS304 and NCF601 were prepared as follows. The comparative example as were fluorinated for 40 minutes with the same fluorinating gas in the same furnace under the same condition as the above EXAMPLE. Then, after exhausting fluoride-containing gas from the furnace, nitriding gas (50 vol % $NH_2$, 25 vol % $N_2$ and 25 vol % $H_2$) was introduced therein and the inside was heated up to 580° C., which state had been kept for 3 hours for nitriding.

From the results of the above table 2, it takes a long time for examples to rust in SST than nitrided articles and no change was occurred to examples in soaking into 15% $HNO_3$, which shows superiority of examples to nitrided articles. Furthermore, nitrided articles were magnetized while examples were not magnetized at all. Still furthermore, compared with nitrided articles, blisters were hardly caused, resulting in high dimension accuracy.

EXAMPLE 2

An M6 bolt formed by pressing SUS316 (17 wt % Cr, 13 wt % Ni, 3 wt % MO and the remainder Fe) wire rod, a tapping screw in 4 mm diameter formed by pressing non-magnetic stainless steel (17.8 wt % Cr, 11.5 wt % Ni, 1.4 wt % Mn, 0.5 wt % N and the remainder Fe) wire rod, and an SUS316 plate and an SUS304 plate as same as Example 1, were put into the furnace in FIG. 1, and were heated up to 400° C. and then fluorinated in the same way as Example 1. Next, gas mixture for carburizing (50 vol % CO, 10 vol % $H_2$ and the remainder $N_2$) was introduced into the furnace, which state had been retained for 32 hours for carburizing. In this case, fluoriding and carburizing were almost at the same time. Samples thus obtained were subjected to air blast so that a black layer (1 to 2 μm thickness) on the surface was removed and then the surface hardness was measured. Each hardness of the M6 bolt formed by SUS316, the non-magnetic tapping screw, the SUS316 plate, the SUS304 plate was Hv of 820, 860, 780 and 830 respectively, and each depth of hard layer were 18 μm, 19 μm, 20 μm and 21 μm, respectively.

Then, thus obtained examples were soaked into 60% solution of 15% $HNO_3$ for 30 minutes so that iron attached thereon was completely removed. And then, the examples were subjected to SST for examining anti-corrosion property. As a result, the SUS316 bolt, the non-magnetic stainless screw, the SUS316 plate did not rust at all over 480 hours. SUS304 plate made a reddish rust slightly in 71 hours. From these results, excellent anti-corrosion property was obtained as same as the above examples.

EXAMPLE 3

An SUS316 plate, an SUS304 plate and an NCF601 plate same as EXAMPLE 1, were put into the same furnace as EXAMPLE 1, and heated up to 400° C., and fluorinated in the same way by introducing the same fluoride-containing gas as used in EXAMPLE 1, and heated up to 480° C., as such a state had been retained, and then carburizing gas (endothermic gas: 30 vol % RX, 2.5 vol % $CO_2$ and 65 vol % $N_2$) was introduced. After such a state had been retained for 12 hours, all examples were withdrawn. Black scale was attached to the surface of thus obtained examples. To remove this black scale, strong acid treatment was conducted. That is, they were soaked into the strong acid (mixture solution of 15 vol % $HNO_3$ and 3 vol % HF) at 50° C. for 10 minutes and were subjected to air blast. As a result, the black scale was removed so that their surface became the same as that of untreated article (in which neither fluorination and carburizing were conducted) in appearance. On the other hand, samples which were carburized after fluorination without strong acid treatment were prepared for comparison with the above samples with strong acid treatment. Both samples with or without acid treatment were subjected to measurement of surface hardness, depth of hard layer and SST. The results are shown in the following table 3.

TABLE 3

| | 316 VOLT | NON-MAGNETIC TAPPING SCREW | 316 PLATE | 304 PLATE |
|---|---|---|---|---|
| Core Hardness (Hv) | 370 | 480 | 240 | 340 |
| Surface hardness (Hv) | | | | |
| after carburizing | 900 | 920 | 870 | 920 |
| after acid treatment | 850 | 870 | 820 | 670 |
| Hard layer depth (μm) | | | | |
| after carburizing | 28 | 27 | 28 | 27 |
| after acid treatment | 25 | 24 | 25 | 20 |
| Time to rust by SST (h) | | | | |
| after carburizing | 24 | 12 | 26 | 7 |
| after acid treatment | not less than 480 | not less than 480 | not less than 480 | 36 |

From the above table 3, it is found out that anti-corrosion property treated with strong acid was greatly improved than that of untreated ones.

Figure 2A:
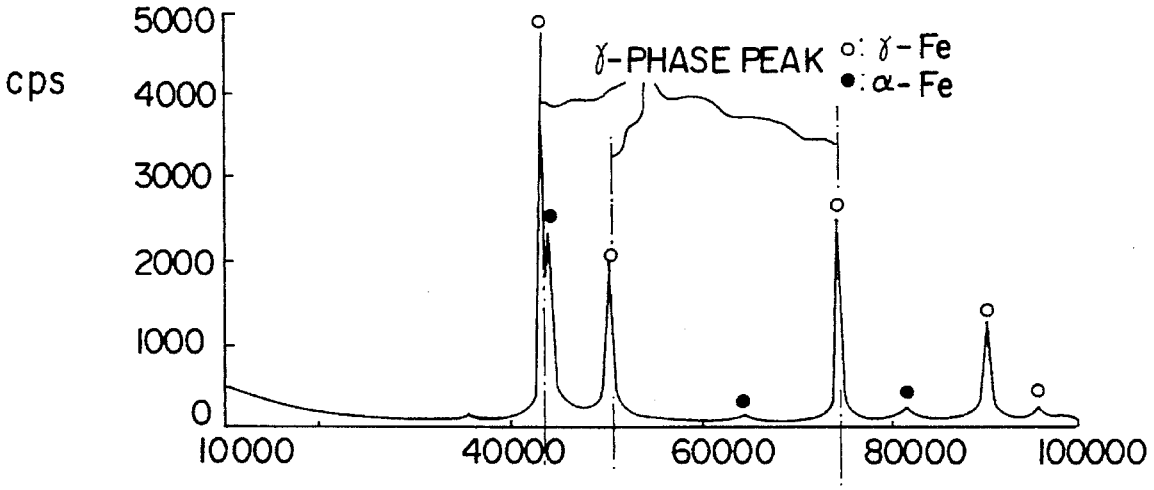
Figure 2B:
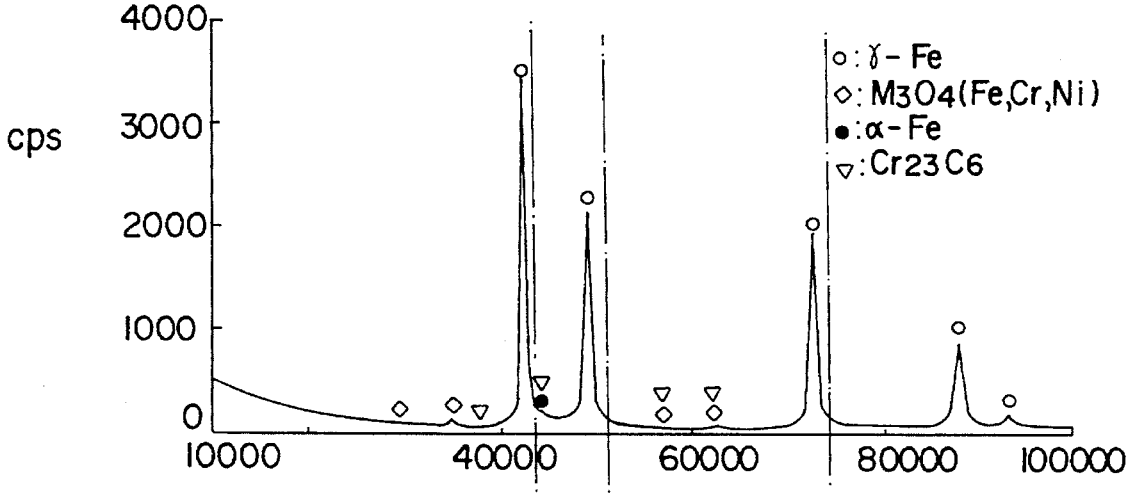
Figure 2C:
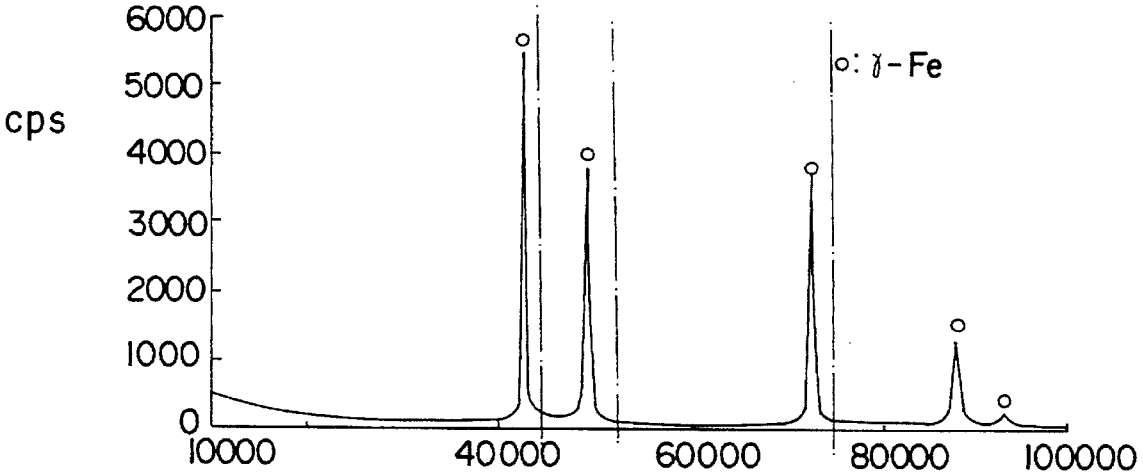

Further, the results of x-ray diffraction on the SUS316 plate treated with strong acid were shown in FIG. 2 (*c*), in which Cr carbide was not fixed at all. Furthermore, a peak of γ layer was shifted to a low angle side than that of untreated ones due to lattice distortion caused by much carbon contained in baseγ-layer lattice. As a result, hardness was improved.

EXAMPLE 4

An SUS316 plate same as that employed in EXAMPLE 1 was fluorinated in the same way as EXAMPLE 1, and then heated up to 600° C. Subsequently, carburizing gas (50 vol % $N_2$ and 50 vol % RX) was introduced therein and withdrawn after being kept for 4 hours.

The surface hardness of this example is Hv of 900 and the depth of a hard layer was 35 μm. After the surface was polished, this example was subjected to SST. It took 4 hours to rust, which was better than that of nitrided examples, however, was thought to be not enough as a carburized example.

Figure 3:
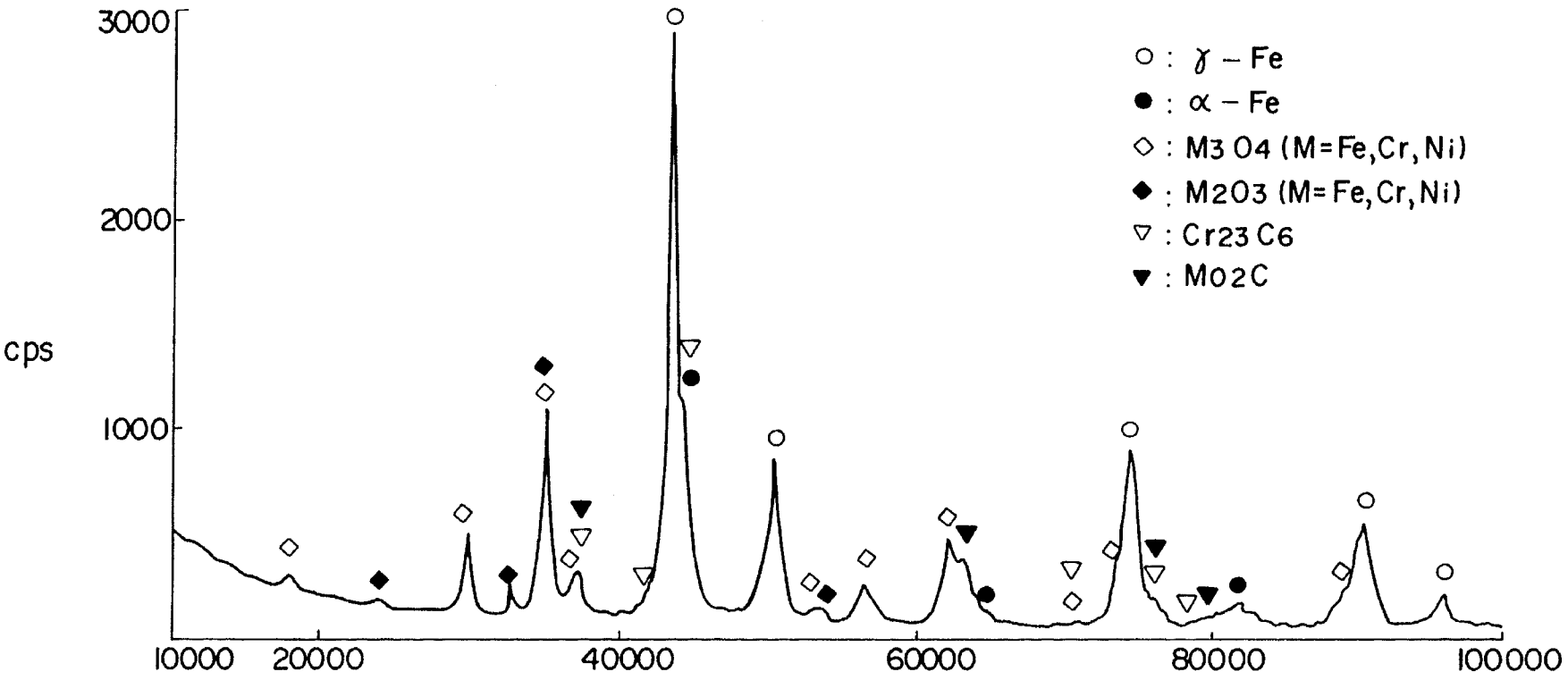
FIG. 3 shows a curve of x-ray diffraction on an SUS316 article which was carburized at 600° C.

The x-ray diffraction was shown in FIG. 3, in which a lot of sharp diffraction of Cr carbide and Mo carbide were identified.

EXAMPLE 5

By employing a bolt made of an SUS316 plate and a tapping screw made of non-magnetic stainless steel same as those in EXAMPLE 2 and employing fluorinating gas and carburizing gas same as those in EXAMPLE 3, fluorination and carburizing were conducted simultaneously. In this case, the temperature was set at 510° C. and the time was 8 hours. On the heads of thus obtained screws, surface hardness was Hv of 920 and 980, the depth of the hard layer was 26 μm and 28 μm respectively.

After conducting acid treatment same as that of EXAMPLE 3, the surface hardness were measured, resulting in drastic decrease to Hv of 580 and 520 respectively.

Since the carburizing temperature was higher than that of EXAMPLE 2 by 30° C., much chrome carbide deposited on the surface. As a result, parts having poor corrosion resistance spread and were eroded by strong acid, which is thought to bring about deterioration in surface hardness.

EXAMPLE 6

An SUS316 plate same as that of EXAMPLE 1 and a bar made of incoloy 825 (42 wt % Ni, not less than 21.5 wt % Cr and 30 wt % Fe), heat resistance steel, were fluorinated in the same way as that of EXAMPLE 1, and heated up to 650° C. Subsequently carburizing gas was introduced, maintained in that state for 5 hours and then withdrawn. Each surface hardness and depth of each hard layer of examples were measured. The surface hardness of the SUS316 was Hv of 1080 to 1100 and that of the incoloy 825 was 1150 to 1180. In the meantime, the depth of each hard layer was 35 to 40 μm.

Subsequently, time to rust by SST, erosion by $HNO_3$ strong acid solution (temperature: 50° C.) and magnetic permeability were measured. The results were as good as those of the SUS316 plate in EXAMPLE 1.

EXAMPLE 7

A plurality of SUS 316 plates (17.5 wt % Cr, 11 wt % Ni and 2 wt % NO) having core hardness same as that conducted with solution treatment, SUS304 plates (0.06 wt % c, 17.5 wt % Cr, 8 wt % Ni and remainder Fe) and M6 volts formed by pressing SUS316 wire rod were prepared. Among these, a several plates and volts of each items were put into the furnace in FIG. 1, heated up to 320° C., fluorinated by introducing fluorinating gas (10 vol % $NF_3$ and 90 vol % $N_2$) and withdrawn from the surface as fluorinated samples.

Subsequently, the remaining items were put into the furnace in FIG. 1 as non-fluorinated samples together with the above fluorinated samples and heated up to 460° C., maintained in that state, and carburized for 12 hours by introducing carburizing gas (20 vol % CO, 75 vol % $H_2$ and 1 vol % $CO_2$).

Among the above samples, fluorinated samples (examples) showed black surface. On the other hand, non-fluorinated samples (comparative examples) showed metallic luster almost same as the appearance before treatment. Next, measured surface hardness was each between Hv of 920 and 1050. In addition, the depth of hard layer was between 20 μm and 25 μm. On the other hand, no improvement in surface hardness could not be seen in comparative examples; non-fluorinated samples.

COMPARATIVE EXAMPLE

The object was an M6 volt formed by pressing wire rod employed in EXAMPLE 7. The hardness of the head and the screw thread in this volt reached Hv of 350 to 390 by the above press forming. This volt was carburized by putting into a normal all case type carburizing furnace of Job Shop (a subcontractor for heat treatment) so as to be carburized at 920° C. for 60 minutes.

As a result, the surface hardness of the carburized volt reached Hv of 580 to 620 and the depth of the hard layer was 250 μm. However, the hardness of the head and the screw thread drastically decreased to Hv of 230 to 250. Then, this carburized volt was subjected to SST, resulting in red rust in 6 hours.

What is claimed is:

1. A method of carburizing austenitic metal comprising steps of holding austenitic metal in a fluoride-containing gas atmosphere with heating prior to carburizing and carburizing the austenitic metal at a temperature not more than 680° C.

2. A method of carburizing austenitic metal according to claim 1, wherein a carburizing temperature is set within a range of 400° to 500° C.

3. A method of carburizing austenitic metal according to claim 2 wherein a temperature in fluoride-containing gas atmosphere is set within a range of 250° to 450° C.

4. A method of carburizing austenitic metal according to claim 3, wherein austenitic metal is austenitic stainless steel.

5. A method of carburizing austenitic metal according to claim 4, wherein austenitic metal is Ni base alloy containing 32% by volume nickel.

6. A method of carburizing austenitic metal according to claim 1, wherein a temperature in fluoride-containing gas atmosphere is set within a range of 250° to 450° C.

7. A method of carburizing austenitic metal according to claim 6, wherein austenitic metal is austenitic stainless steel.

8. A method of carburizing austenitic metal according to claim 2, wherein austenitic metal is austenitic stainless steel.

9. A method of carburizing austenitic metal according to claim 8, wherein austenitic metal is Ni base alloy containing 32% by volume nickel.

10. A method of carburizing austenitic metal according to claim 1, wherein austenitic metal is Ni base alloy containing 32% by volume nickel.

11. A method of carburizing austenitic metal according to claim 1, wherein austenitic metal is austenitic stainless steel.

12. A method of carburizing austenitic metal according to claim 6, wherein austenitic metal is Ni base alloy containing 32% by volume nickel.

* * * * *